US005991926A

United States Patent [19]

Lakusiewicz

[11] Patent Number: 5,991,926

[45] Date of Patent: Nov. 30, 1999

[54] ELASTOMERIC GLOVE WITH SILICONE COATING

[76] Inventor: Ronald J. Lakusiewicz, 1316 Euel Rd., Poplar Bluff, Mo. 63901

[21] Appl. No.: 09/065,786

[22] Filed: Apr. 23, 1998

[51] Int. Cl.[6] ..... A41D 19/00

[52] U.S. Cl. ..... 2/168; 2/161.1; 2/163; 2/917; 473/59

[58] Field of Search ..... 2/16, 161.1, 161.5, 2/161.8, 163, 159, 164, 167, 168, 169, 170, 914, 917, 919, 910; 428/391, 405; 442/65, 101; 294/25; 473/59

[56] References Cited

U.S. PATENT DOCUMENTS

| | | | |
|---|---|---|---|
| 4,608,720 | 9/1986 | Purin | 2/161 |
| 5,117,509 | 6/1992 | Bowers | 2/161 |
| 5,330,391 | 7/1994 | Mitchell | 2/161 |
| 5,474,839 | 12/1995 | Ogawa et al. | 428/266 |
| 5,511,247 | 4/1996 | Block | 2/161.1 |
| 5,581,809 | 12/1996 | Mah | 2/20 |
| 5,625,900 | 5/1997 | Hayes | 2/161.8 |
| 5,689,828 | 11/1997 | Mah | 2/16 |
| 5,804,707 | 9/1998 | Scarton et al. | 73/82 |

*Primary Examiner*—Diana Oleksa
*Assistant Examiner*—Katherine Moran
*Attorney, Agent, or Firm*—Blackwell Sanders Peper Martin

[57] ABSTRACT

The invention is a one piece glove used as a sports aid to decrease slippage during grip, that is comprised of an elastomeric fabric component which fits precisely incorporating all the fingers of the hand; the wrist; and the thumb. The elastomeric fabric component is completely flexible not containing any rigid positional elements for the wrist or fingers. The palmar side of all the finger sleeves of the glove, as well as the palm of the glove have attached a silicone of prosthetic quality which is fused to the elastomeric fabric in such a fashion that all the external aspects of the finger sleeves facing the sports apparatus such as, but not limited to, a bowling ball, as well as the internal aspects facing the fingers are fused with the silicone. The surface of the palm of the glove is comprised of silicone and elastomeric fabric fused on the external aspect that contacts the bowling ball, and the internal aspect that contacts the palm itself. This construction of silicone fusion to elastomeric fabric greatly increases the ability of the bowler to grip the ball with less force because slippage is reduced. The adherence to the ball of the silicone plus its shock absorbing effect relative to the fingers allows greater "lift" and increased revolutions of the bowling ball upon ball release from the hand thus imparting greater energy applied to the pins upon impact.

21 Claims, 5 Drawing Sheets

ELASTOMERIC GLOVE WITH SILICONE COATING

FIELD OF INVENTION

This invention relates to a glove adapted to be worn on the hand of a user who is preferably a bowler, but who may be a participator in any sport or activity which necessitates a firm grip, free of slippage.

BACKGROUND OF THE INVENTION

Many bowling accessories have been developed represented by wrist splints, tape to be put into ball holes, towels, finger plugs which attach to the bowling ball, resin bags, and various skin adhesives all of which have the purpose of allowing the bowler better grip and control of the ball.

One particular bowling aid, the glove has had many attempts at introduction, but most have proved unsatisfactory. Prior art in gloves has usually attempted to combine in some way, a variation of a glove (with multiple finger sleeves, some of the sleeves open and some closed) and a wrist and/or forearm support stiffened by plates of some rigid substance as in the devices of Charles Robinson, Edward Patton, James Duggin, George Hollman, and Charles Purin. This combination of glove and wrist brace, was an attempt at controlling position of the hand and wrist in a straight line during delivery of the ball, for better ball control.

Attempts at decreasing impact to the bowler's hand by proponents of the glove plus wrist brace concept were made by inserting various foam pouches in the finger sleeves (Kenneth Mitchell), or by using a resilient pad in the palm or long and ring finger sleeves as in the inventions of Robert Krzewinski et al, Joseph Andolino, and Torrence Ingold.

An attempt at improving velocity of the bowling ball was made by Charles Purin with his invention comprised of a rigid wrist plate and a rigid hand plate with rigid projections to the fingers. Another attempt to increase ball velocity was made by placing a spring in the palmar pocket of a glove invented by Brigidi and Hebling.

Placing weights in a glove applied to the bowler's opposite free hand to provide counterbalance to the ball-holding hand was advocated by Lewis Wester.

An entirely different idea was put forth by another group of inventors who espoused that only finger covers and not gloves might help the control, grip, and delivery of the bowling ball. These finger covers were sometimes rigid in character (David Albert); were sometimes control loops or straps attached by proximal extensions to the hand (James Loafman, Albert Rasche); and in other devices the finger supports were attached to a glove via knobs to prevent overtaxing muscles (William Gooch). Some inventors created a finger support totally unattached proximally and used it to cover only the little finger of the bowling hand, predicated on the concept that during ball release the little finger support alone would center the ball in the palm and allow greater control (Paul Buneta).

None of the aforementioned devices have stood the test of time. Only two gloves produced by Ebonite and AMF have had only fair success to date. The Ebonite example of prior art termed the Ultra-Gripper™ has a sprayed-on Tackified™ substance placed onto thin soft leather which must be rejuvenated weekly by washing the glove with soap and water. The soft thin leather offers no protection to the joints or skin of the bowler, particularly the young and elderly bowler, whose joints and skin are particularly prone to injury. The Ebonite glove fails to provide shock absorbency to the joints. The AMF glove has a rough surface rubber palm and finger section without splinting benefit to the index or little fingers and offers no direct benefit to the skin other than a claim of being "breatheable".

The present invention attempts to deal with the shortcomings of prior art in a different, yet simple way, by fusing a prosthetic quality silicone onto an elastomeric fabric such as, but not limited to, spandex-nylon. Silicone has not previously been used in the manner in which it is employed in the present invention. Silicone has been incorporated into tubular plugs which are then glued into the bowling ball holes themselves, but the manner and method of use in the present invention are completely different.

Silicone is generally thought of as a lubricating substance rather than a shear force resisting substance, the property of which being easily illustrated by placing a flat piece of "cured" prosthetic silicone on any polished table top and then trying to move the piece of silicone sideways along the tabletop using one or two fingers. One instantly finds that the piece of silicone resists movement and appears to stick to the tabletop. The "cured" prosthetic silicone also has the ability to be compressed, and itself to be slightly elastic which allows for a significant degree of shock impact absorbancy depending on the firmness of which the silicone is "cured" based on the Shore durometer system of firmness rating. Also of significant importance is the fact that stiffness of the device may be controlled by using the appropriate silicone of higher Shore durometer rating plus, applying multiple coatings of the silicone in its "pre-cured" state to form the device.

Because of improved grip and control that the present invention allows the bowler to impart to the bowling ball, the bowler is able to throw or deliver a lighter weight ball with greater velocity thus employing a greater kinetic energy to strike the pins as the kinetic energy is represented by the formula:

$KE = \frac{1}{2} MV^2$ where

KE=Kinetic Energy

M=Mass or Weight of the bowling ball

V=Velocity which clearly shows that the greatest increase in kinetic energy comes from the velocity with which the ball is thrown raised to the 2nd power or squared.

Also, it has been recently shown medically, that "cured" silicone when in contact with the skin, has the ability to soften the skin and reduce scar formation. Sheets of this type of silicone are being used at the present time as post-surgical dressings to control the scarification process. The present invention contains a thin coating of silicone inside the finger sleeves of the glove, purposely contacting the skin of the fingers and palm in order to prevent or decrease callous formation, nail splitting and separation, and deformity.

Thus by addressing all the important factors of ball handling such as grip, control, impact, velocity, and hand protection,—the present invention sets itself uniquely apart from all prior art.

BRIEF SUMMARY OF THE INVENTION

The present invention is a glove adapted for use on the hand of a participant in a sport, which in this case is demonstrated by the sport of bowling. The glove is totally flexible made of an elastomeric material, such as but not limited to, a spandex-nylon combination with a wrist enveloping proximal end entrance that continues in complete hand enveloping fashion to the level of the distal palm overlying the metacarpophalangeal joints at which point, the glove continues distally as individual finger sleeves to cover the index, long, ring, and little fingers to varying degrees leaving the thumb minimally covered. The present invention is further comprised of fully "cured" prosthetic quality silicone that has been fused thermally to the palm of the glove and to the external palmar surface of fingers index, long, ring, and little and the thumb, in varying thickness, continuing as one piece around the palmar edge of each open-ended finger sleeve onto the internal aspect of the palmar surface of each finger sleeve where the silicone thickness is the least. The fused silicone coating is discontinuous for about one centimeter on the palmar aspect of the glove between the attachment of the finger sleeves to the palmar portion of the glove and the palm of the glove itself. From this point, the palm of the glove is completely covered with the fused silicone, with the silicone covering extending on both external and internal aspects of the palm portion of the glove to the level of the flexion crease of the wrist. The back aspect of the glove covering the fingers, hand, and wrist, are completely devoid of silicone. While the elastomeric property of the spandex is adequate of itself to maintain the glove properly positioned on the hand during use, the proximal opening of the glove at the wrist level which allows entrance of the hand into the glove, may be further secured by the incorporation of strips of elastic banding material sewn into the spandex-nylon or the use of hook and loop fastener material, thus allowing the creation of different styles of the same basic glove without compromising function. The glove is constructed in sizes of small, medium and large for the right and left hands, and has different finger sleeve configurations for use with the two primary drilling configurations of bowling balls that allows insertion of the fingers.

For the conventionally drilled bowling ball that allows complete insertion of fingers long, ring, and thumb, the glove construction has complete coverage by the finger sleeves of fingers index and little with closed-ends; minimal coverage of the thumb, and coverage of fingers long and ring by the finger sleeves up to the mid-portion of the distal phalange of the fingers ending at this point open-ended. The conventionally drilled ball allows full insertion of the fingers long and ring together with covering finger sleeves, into the respective ball holes up to the level of the bowler's comfort.

For the bowling ball that is drilled for use with a "finger tip grip" configuration of fingers long and ring, the glove construction has complete coverage by the finger sleeves of fingers index and little with closed-ends; minimal coverage of the thumb; with coverage of fingers long and ring by the finger sleeves ending in open-ended fashion at the level of the proximal interphalangeal joints. This configuration allows the normal insertion of fingers long and ring into the "finger tip" drilled ball only up to the distal interphalangeal joints which this manner of drilling is meant to do. The finger sleeves of the glove are not meant to enter the holes for fingers long and ring of a bowling ball drilled for use as a "finger tip grip".

Advantages of the present invention over prior art are:

1. Much better grip of any hand held convex sports apparatus, such as but not limited to, a bowling ball drilled in any fashion because of the ability of the invention's particular "cured" silicone to resist shear force thus preventing slippage between the convex surface and the fingers and hand.

2. With the hand in the glove, sweating is not a problem at the interface between the convex surface and hand.

3. The better grip imparted by the shear resistant silicone surface allows the user to use less muscle force to hold the convex surface apparatus thus avoiding manuevers such as "strangling the ball", overtaxing muscles of the hand, and producing fatigue.

4. Better control of a bowling ball is facilitated not only by the better grip, but also by fingers index and little which have an added ability to direct the ball by applying additional thickness coatings of silicone to the index and little finger sleeves. This tends to stiffen the index and little finger sleeves which gives them a "splint-like" characteristic which helps the bowler better control the delivery of the ball to the surface of the bowling lane; its direction for more precise control; and to increase ball revolution.

5. The better grip and control allows the bowler to use a lighter weight bowling ball thus further decreasing muscle fatigue, but also importantly, allowing the bowler to increase the velocity with which the ball is rolled. The increased velocity is the most important factor in determining the kinetic energy with which the ball strikes the pins as shown by the formula for calculating kinetic energy of [$\frac{1}{2}$ $MV^2$] where the contribution of the velocity is according to the 2nd power or square of the velocity thus allowing a lighter weight bowling ball to have the same striking power as a much heavier weight ball.

6. In addition to the increased contribution of the velocity to the striking power of the bowling ball, the striking power is further enhanced by the increased number of revolutions of the ball during its travel to the pins which have been imparted by the sudden removal of the shear force resistance upon release of the ball. This combination of increased velocity and increased revolutions (spin) occurring simultaneously causes greater "mixing" action or disarray of the pins as they are caused to fall about when struck by the ball.

7. The conventionally drilled bowling ball gets the same benefit of increased "lift" and ball revolution as the "finger tip grip" drilled bowling ball because when the long and ring fingers and finger sleeves exit the ball holes upon ball release, the shear resistant silicone coatings impart a "flicking" action to the ball which increases the "lift" and ball revolutions, not possible before.

8. The thickness of the fused silicone coating applied to the finger sleeves and its resilient elastic properties, allow a significant cushioning of the impact of forces to the joints of the hand. This is important in preventing injury to users of all ages, but particularly the elderly bowler who may have arthritis and the children who still have growth plates present in the bones of their hands and fingers.

9. The medical use of silicone sheeting treatment for painful scarification is now well known. The same principle is applicable to the fused silicone coating internally applied in the finger sleeves and palm to prevent and soften painful calluses, scars, and deformities.

10. Less effort in sports equipment handling and the beneficial effects of direct contact by the silicone to the hand results in less tendonitis and inflammation to the hand, wrist, and elbow.

11. The present invention can be easily customized to any hand deformity.

12. No residue of any kind is left on the sports equipment after use of the present invention.

13. The present invention is a standalone device that also is adaptable for use with any wrist splint of any manufacturer.

DETAILED DESCRIPTION OF THE PREFERRED EMBODIMENT

Figure 1:
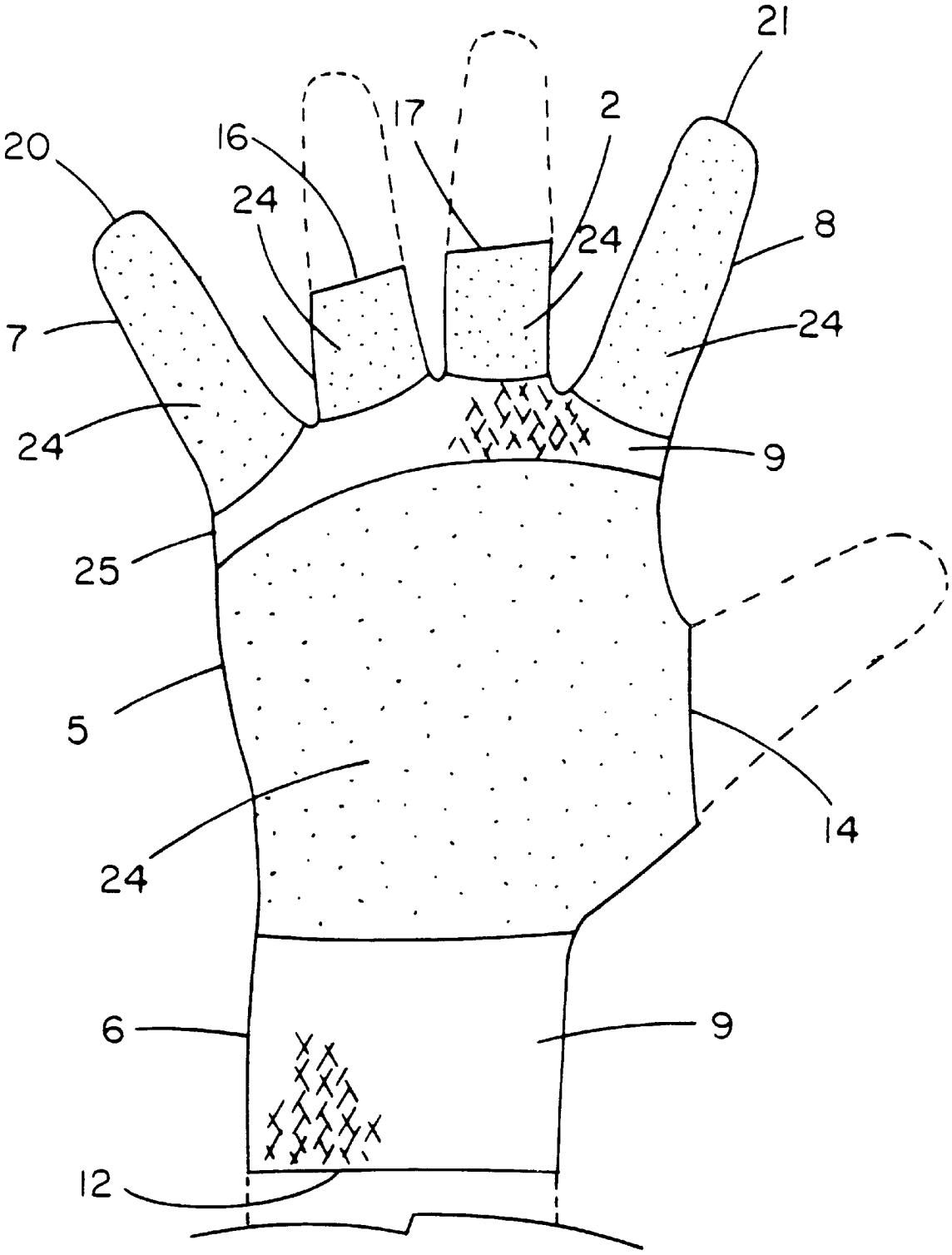
FIG. 1 is a front perspective view of the invention showing the configuration that is best adapted for use with a bowling ball drilled for the "finger tip grip" hole configuration. Finger sleeves 1, 2 extend distally only to the level of the proximal interphalangeal joint of the long and ring finger respectively and at this point terminate open-ended 16, 17. Finger sleeves 7, 8 completely cover the index and little fingers and terminate at the finger tips closed-ended 20, 21. The front perspective of fingers index, long, ring and little is completely covered with prosthetic quality silicone 24 which is fused to the elastomeric component 9 of the invention. The front surface of the palm 5 of the invention is covered by prosthetic quality silicone 24 which is fused to the elastomeric component 9 of the invention extending from the flexion crease of the wrist proximally to approximately one centimeter from the junction of all finger sleeves 1, 2, 7, 8 creating an area 25 of the elastomeric component of the invention that is without silicone coverage, as is the portion of the elastomeric component of the invention proximal to the flexion crease of the wrist 6. The individual finger sleeves are not fused one to the other at any point. The thumb is minimally covered to the level of the metacarpophalangeal joint 14, but uncovered distally to its termination.
Figure 2:
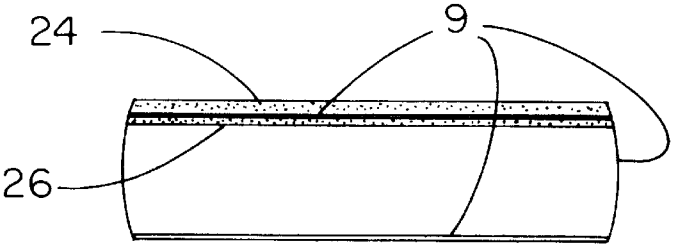
FIG. 2 is a cross section perspective view of the invention at the level of the mid-palm showing the elastomeric component 9 of the invention extending 360 degrees around the palm, sides, and back of the hand with the prosthetic quality silicone 24, 26 fused only to the elastomeric component 9 of the invention covering the front or palmar aspect on the external and internal aspect surfaces.
Figure 3:
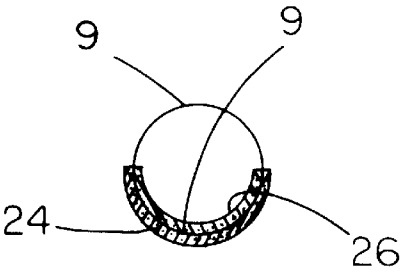
FIG. 3 is a cross section perspective view of the invention showing the finger sleeves 1, 2, 3, 4 of fingers long and ring at the mid-level showing the elastomeric component 9 of the invention extending 360 degrees around the long and ring fingers respectively, with the prosthetic quality silicone 24, 26 fused to the palmar aspect of the elastomeric component 9 of the invention on both the external and internal aspects of the palmar portion of the elastomeric component 9 of the finger sleeves 1, 2, 3 and 4 continuing the full length of the respective finger sleeves, the fusion of silicone extending up to the mid-axial line bilaterally of the respective finger sleeves, thus covering approximately half of the circumference of the finger sleeves 1, 2, 3, 4.
Figure 5:
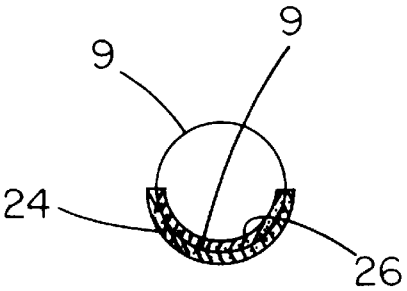
FIG. 5 is a cross section perspective view of the invention showing the finger sleeves 7, 8, 10 and 11 of the index and little fingers at the mid-level showing the elastomeric component 9 of the invention extending 360 degrees around the index and little fingers respectively, with the prosthetic quality silicone 24, 26 fused to the palmar aspect of the elastomeric component 9 of the invention on both the external and internal aspects of the palmar portion of the elastomeric component of the finger sleeves, 7, 8, 10 and 11, continuing the full length of the respective finger sleeves, the fusion of silicone 24, 26 extending up to the mid-axial line bilaterally of the respective finger sleeves, thus covering approximately half of the circumference of the finger sleeves 7, 8, 10 and 11 respectively.
Figure 4:
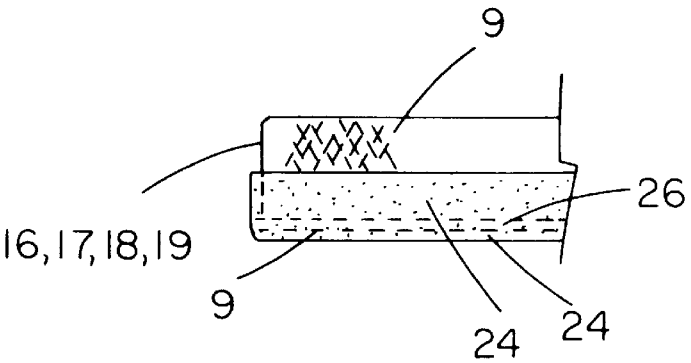
FIG. 4 is a side perspective view of the invention showing the prosthetic quality silicone 24, 26 fusion to the elastomeric component 9 of the invention extending from the palmar surface of the respective finger sleeves 1, 2, 3 and 4 up to the mid-axial line, the fill length of finger sleeves 1, 2, 3 and 4 with the silicone fusion applied to the external aspect of the palmar surface of the respective finger sleeves, continuing around the open-ended border 16, 17, 18, 19 of the respective finger sleeves up to the mid-axial line bilaterally, then continuing on to the internal aspect of the palmar surface of the respective finger sleeves 1, 2, 3 and 4, for the full length of the sleeve.
Figure 6:
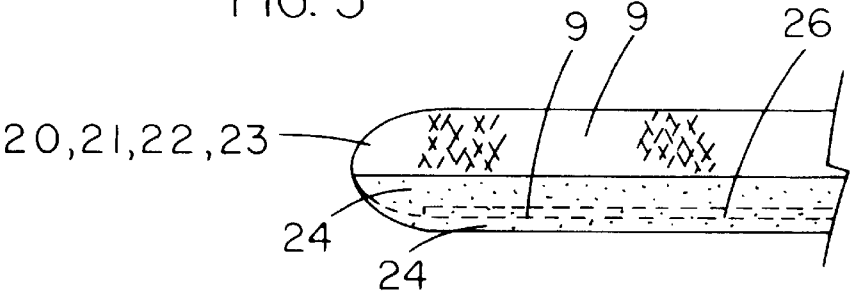
FIG. 6 is a side perspective view of the invention showing the prosthetic quality silicone 24, 26 fusion to the elastomeric component 9 of the invention extending from the palmar surface of the respective finger sleeves, 7, 8, 10 and 11 up to the mid-axial line the full length of the finger sleeves 7, 8, 10, and 11 with the silicone fusion 24, 26 applied to the external aspect of the palmar surface of the respective finger sleeves, extending up to the mid-axial line at the terminus of the close-ended finger sleeves, 7, 8, 10 and 11. The silicone fusion 24, 26 to external and internal aspects of the palmar surface of the elastomeric component 9 is discontinuous at the terminus of finger sleeves 7, 8, 10 and 11 separated by the closed-end 20, 21, 22, 23 configuration of the respective finger sleeves. The silicone to elastomeric component fusion of the internal aspect of the palmar surface of finger sleeves 7, 8, 10 and 11 continues for the full length of the respective finger sleeves.
Figure 7:
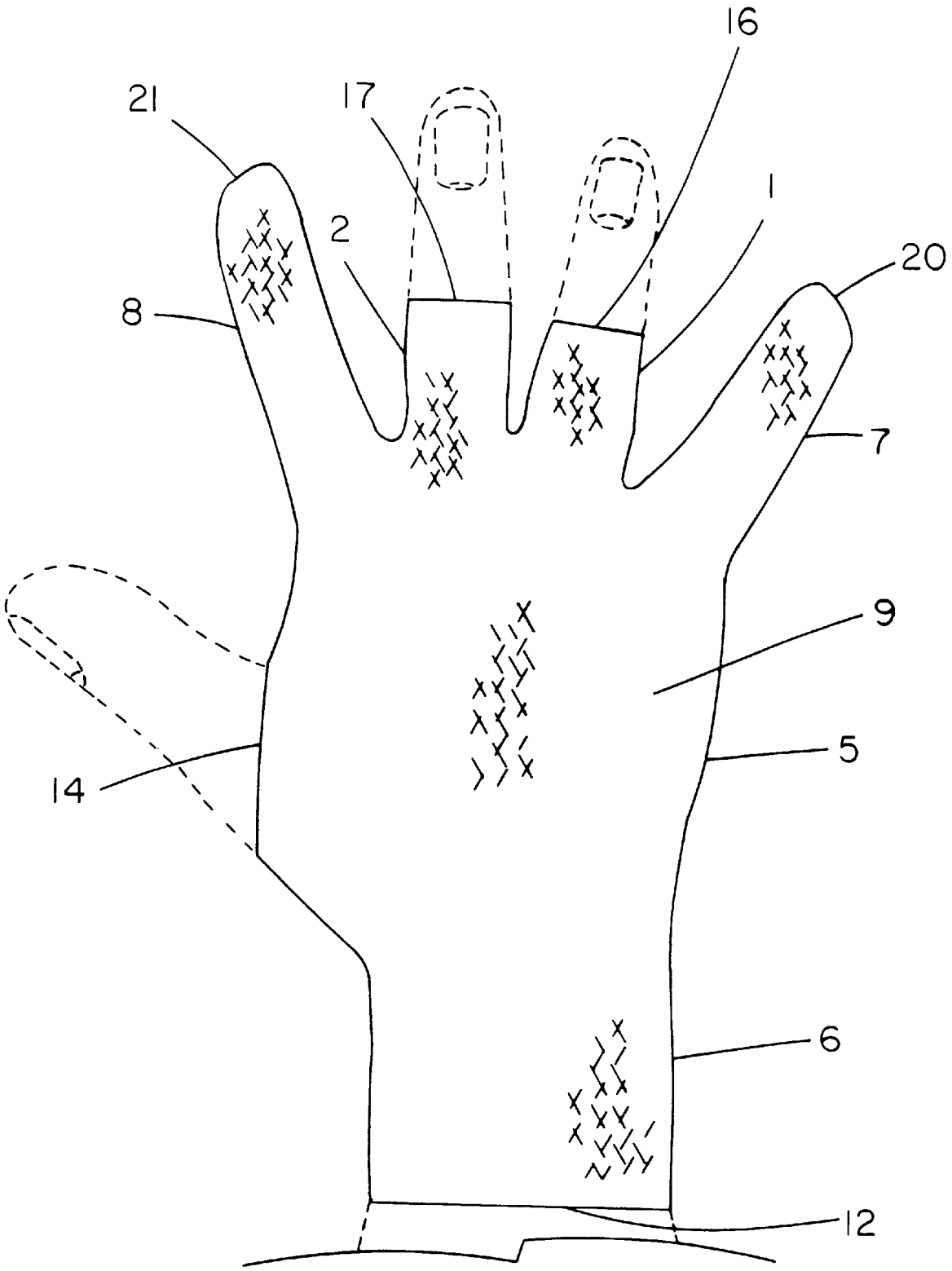
FIG. 7 is a back perspective view of the invention showing the extent of elastomeric component 9 coverage of the hand and fingers with no silicone fusion. This configuration of elastomeric component 9 coverage of the back of the hand and fingers is to be adapted to bowling balls drilled with the "finger tip grip" hole configuration and importantly has elastomeric component 9 coverage of the long and ring fingers distally only up to the level of the proximal interphalangeal joint of the respective fingers; has complete coverage of fingers index and little; and minimal coverage of the thumb to the level of the metacarpophalangeal joint.
Figure 8:
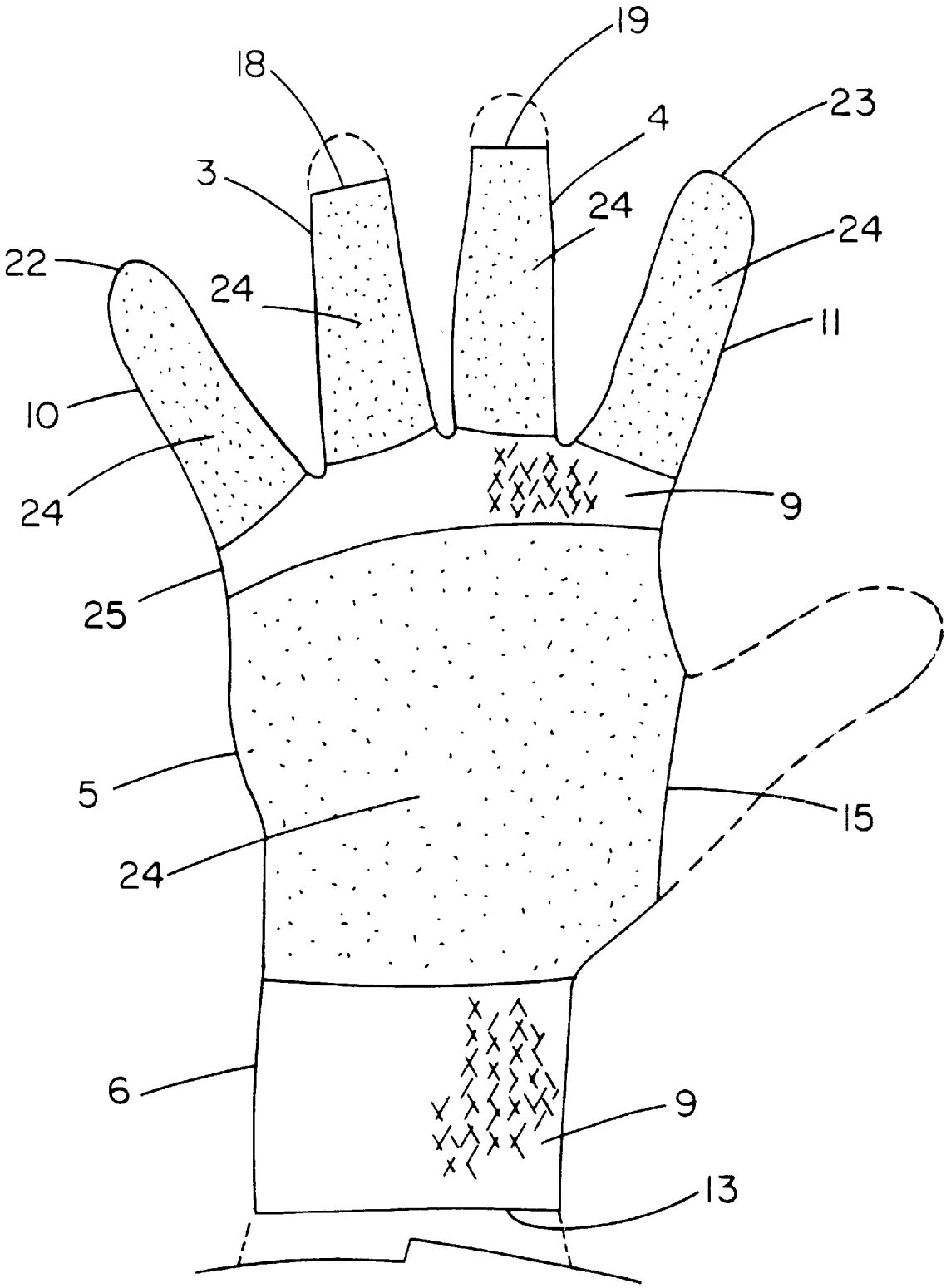
FIG. 8 is a front perspective view of the invention showing the configuration that is best adapted for use with a bowling ball drilled for the conventional hole configuration. Finger sleeves 3 and 4 extend distally up to the level of the mid-point of the distal phalange of the long and ring fingers respectively, and at this point, terminate open-ended 18, 19 finger sleeves 10, 11 completely cover the respective fingers index and little and terminate at the finger tips close-ended 22, 23. The front perspective of fingers index, long, ring and little is completely covered with prosthetic quality silicone 24 which is fused to the elastomeric component 9 of the invention. The front surface of the palm 5 of the invention is covered by prosthetic quality silicone 24 which is fused to the elastomeric component 9 of the invention extending from the flexion crease of the wrist proximally, to approximately one centimeter from the junction of all finger sleeves, 3, 4, 10 and 11 creating an area 25 of the elastomeric component 9 of the invention that is without silicone coverage, as is the portion of the elastomeric component 9 of the invention proximal to the flexion crease of the wrist 6. The individual finger sleeves are not fused one to the other at any point. The thumb is minimally covered to the level of the metacarpophalangeal joint.
Figure 9:
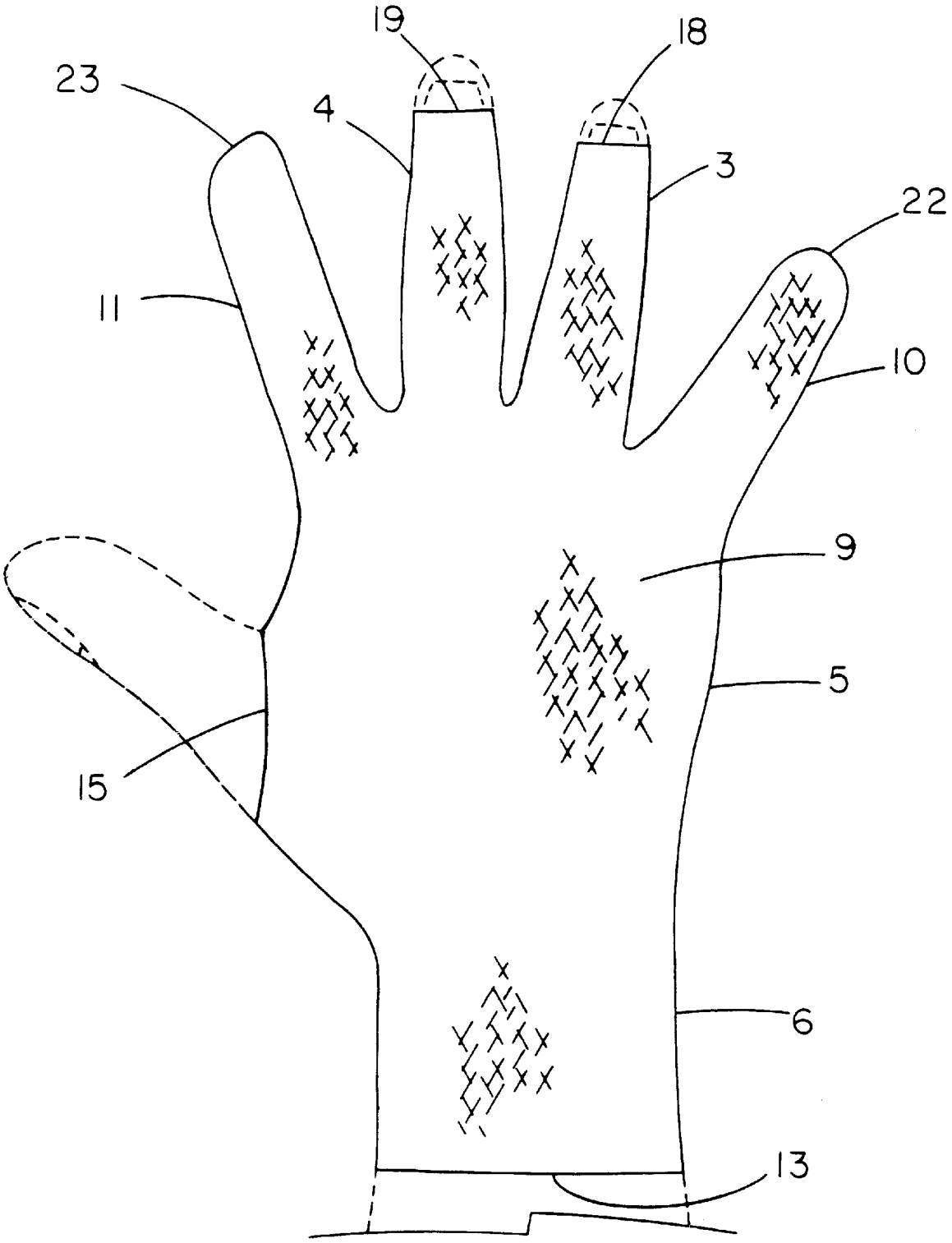
FIG. 9 is a back perspective view of the invention showing the extent of elastomeric component 9 coverage of the hand and fingers with no silicone fusion. This configuration of elastomeric component 9 coverage of the back of the hand and fingers is to be adapted to bowling balls drilled with the conventional hole configuration, and importantly has elastomeric component 9 coverage of the long and ring fingers distally up to the level of the mid-portion of the distal phalange of the respective fingers; has complete coverage of fingers index and little; and minimal coverage of the thumb to the level of the metacarpophalangeal joint.

The present invention is described as two different models which are both constructed according to the principles of this invention, one model, FIG. 8, FIG. 9, adapted for use with a bowling ball that is drilled with the conventional hole configuration which allows fingers long and ring of the ball engagement hand to be inserted completely into the bowling ball in addition to the thumb; the other model, FIG. 1, FIG. 7, adapted for use with a bowling ball that is drilled with the "finger tip grip" hole configuration which allows fingers long and ring of the ball engagement hand to be inserted into the bowling ball only up to the distal interphalangeal joint of respective fingers long and ring, in addition to the thumb which is filly inserted. In both hole configurations of drilling, fingers index and little are not inserted into the ball and rest naturally on the convex contour of the ball during grip. The main difference between the two models FIG. 8, FIG. 9 and FIG. 1, FIG. 7, is the amount of coverage that the finger sleeves 1, 2, 3 and 4 provide for fingers long and ring of the ball engagement hand.

Both models, FIG. 8, FIG. 9 and FIG. 1, FIG. 7, according to the principles of this invention are preferably constructed of a combination of an elastomeric material 9 such as but not limited to, spandex-nylon in proportions of 12.70% spandex plus 87.30% nylon. The elastomeric material 9 fully envelops the hand, fingers, and wrist as shown in FIG. 1, FIG. 7, FIG. 8 and FIG. 9, and is sewn in the standard manner to construct the one piece enveloping coverage of the hand 5, wrist 6, and finger sleeves 1, 2, 3, 4, 7, 8, 10 and 11. The elastomeric component is open-ended to allow entrance of the hand at 12, 13, exit of the thumb at 14, 15 and exit of the long and ring fingers at 16, 17, 18 and 19. Finger sleeves 7 and 8 are close-ended at 20 and 21 respectively, as are the finger sleeves 10 and 11 close-ended at 22 and 23 respectively. The back of both models of the invention FIG. 7, FIG. 9, is comprised totally of elastomeric material 9. The front aspect, of the invention FIG. 1, FIG. 8, is comprised of uncovered elastomeric material 9 at the wrist 6 and distal palm 25, and elastomeric material 9 which is covered by prosthetic quality silicone 24 (PSE-70 from Factor 2, Inc.). The prosthetic quality silicone 24 has a firmness of Shore durometer 70 to enable it to withstand the constant wear transmitted to it by the bowling ball. The prosthetic quality silicone 24 is initially received in the "uncured" state in 2 parts, an activator Part A and a base Part B, which have been commercially prepared by Factor 2, Inc. The silicone 24 is then prepared for the present invention by combining Part A plus Part B of the PSE-70 in equal parts by weight and mixing thoroughly. This combination of mixed Part A plus Part B of PSE-70 silicone is then combined with number 200 medical thinner fluid (dimethylpolysiloxane) (also from Factor 2, Inc.) using an amount of number 200 medical thinner fluid equal to 50% by weight of the combined mixture of Part A plus Part B PSE-70, and mixed thoroughly until the viscosity of the aforestated total mixture allows easy application of the total mixture with a brush. When a brushable flow characteristic of the total mixtures viscosity is attained, this total mixture of "uncured" silicone is then placed in a vacuum chamber at 760 mm Hg until all the air and solvent have been removed. The total mixture of "uncured" silicone is then removed from the vacuum chamber, and is then applied with a brush to the front aspect FIG. 1, FIG. 8 of the present invention while the elastomeric material 9 is held firmly stretched over a model of the anatomical hand, wrist and fingers made of, but not limited to, polyethylene or aluminum. The stretching of the elastomeric material 9 separates the multiple weave pattern structure and allows the "uncured" silicone to fully enter all the interstices, thus giving a total incorporation of the "uncured" silicone both into and onto the external aspect of the front aspect FIG. 1 and FIG. 8 of the palm 5 and finger sleeves 1, 2, 3, 4, 7, 8, 10 and 11. The present invention prepared in the aforementioned manner is then placed in a conventional oven at temperature 200 degrees F for 8 minutes, which allows the prosthetic quality silicone 24 to "cure" and completely fuse with the elastomeric component 9 of the present invention. After "curing" of the silicone PSE-70, 24, the invention is removed from the oven and allowed to cool to room temperature. (For this invention, "curing" is defined as the change in physical characteristics that the silicone undergoes when altered from an unstable, amorphous, pourable, liquid state termed "uncured" to a stable, non-reactive, formed, non-pourable solid state caused by application of thermal energy for given time period, termed "cured".)

A less firm prosthetic quality silicone (PSE-05) of Shore durometer 05, 26, which is prepared in the same aforementioned manner as the firmer silicone PSE-70, 24, being appropriately mixed, thinned-down and vacuum de-aired is applied in a slightly thinner coating to the internal aspect of the palm 5 and finger sleeves 1, 2, 3, 4, 7, 8, 10 and 11, of the front aspect FIG 1, FIG. 8 of the elastomeric material 9, after inversion of the invention.

Without the stretching model insert of aluminum or polyethylene, etc., the invention is then reintroduced into the conventional oven at 200 degrees F for another 8 minutes. This second exposure to increased thermal energy allows the prosthetic quality silicone PSE-05, 26, to "cure" and simultaneously fuse to the internal aspect of the elastomeric material 9 of the palm 5 and finger sleeves 1, 2, 3, 4, 7, 8, 10 and 11 of the front aspect FIG. 1, FIG. 8, of the present invention, this producing a complex composite fusion at the aforementioned areas of firm silicone PSE-70, 24, plus elastomeric material 9, plus softer, less firm silicone PSE-05, 26. The invention is then removed from the oven and allowed to remain at room temperature for not less than 48 hours without manipulation except for reinversion.

FIG. 1, 7, 8, and 9 represent the basic configuration of the present invention for bowling, but are not all inclusive of design variations for bowling and other sports. The invention may be used for any sport or activity which presents a convex surface apparatus that necessitates firm grip, free of slippage. The proximal extent of the invention at the wrist 6 may be varied in a manner to include, but not be limited to, length changes, openings on front, side, or back aspects; inclusion of other manner of securing methods such as, but not limited to, elastic banding, hook and loop fastener attachments, snaps, or other elastomeric tightening materials and methods.

All the finger sleeves 1, 2, 3, 4, 7, 8, 10, and 11, and the thumb sleeve openings 14, 15, may include variations in their design, formation, and relationship to one another and relative to their extensions from and attachments to the main body portion of the invention.

The invention may employ a thumb sleeve of variable length, ending either closed or open-ended, and coated with a silicone surface fused onto the elastomeric component of the thumb sleeve on either the internal or external aspect or both, of the thumb sleeve.

The disposition of the pattern and distribution of the silicone to elastomeric component fusion of the invention is variable depending on the requirements of the different sports and activities.

This present invention is created to be adaptable to all kinds of hand conditions and deformities; to permit "on-the-fly" adjustments without destroying function; and to employ a method of prevention and alternative treatment for tender, scarred, calloused, and deformed hands of bowlers, and athletes of other sports and activities.

OPERATION

The present invention is quickly and easily put on by sliding the fingers, hand, and wrist through the entrance of the invention at the proximal end of the wrist portion 12, 13 until all the fingers are covered in their respective finger sleeves 1, 2, 3, 4, 7, 8, 10 and 11, up to the level of all metacarpophalangeal joints; the thumb exits the invention uncovered, at the side of the palmar aspect 14, 15 to the level of the metacarpophalangeal joint of the thumb; and the invention is pulled by its proximal wrist end 6 to allow the palmar portion of the invention 5 to evenly cover the palm, and the wrist 6 portion of the invention to evenly cover the wrist.

The invention is used in a manner that is appropriate for each respective sport and activity. For the sport of bowling, the bowling ball is gripped by the hand covered by the invention in the above manner by inserting the long and ring fingers and the thumb into the appropriate holes of the bowling ball; placing the covered palm of the hand in full contact with the convex surface of the bowling ball; and then turning the forearm, wrist, and hand into fill supination.

In the "finger tip grip" model of the invention FIG. 1, FIG. 7, only the uncovered portion of the long and ring fingers that have exited the finger sleeves 1, 2 at their respective open ends 16, 17 are inserted into the ball holes up to the level of the distal phalangeal joints, with the thumb fully inserted into its respective ball hole.

In the conventional grip model of the invention FIG. 8, FIG. 9, the uncovered portion of the long and ring fingers that have exited the finger sleeves 3, 4 at their respective open ends 18, 19, are inserted into the ball holes along with the covering portion of the finger sleeves 3, 4 of the long and ring finger up to the level that is comfortable for the bowler, with the thumb fully inserted into its respective ball hole.

The index and little fingers, which are fully covered by finger sleeves 7, 8, 10 and 11, and do not exit their respective finger sleeves at ends 20, 21, 22, 23, are placed in full contact with the convex surface of the ball being placed in such manner that they are spread away from the long and ring fingers in varying degrees.

At the instant of release of the bowling ball grip by the invention covered hand as the ball is completing its swing arc of delivery by the arm of the bowler thus imparting to the ball a velocity of travel down and across the bowling lane surface, the grip is released suddenly by flexing the long and ring fingers; rotating the forearm, wrist, and hand from full supination to full pronation; turning and guiding the ball with the index and little fingers; all the aforementioned actions occurring simultaneously.

The high degree of shear force resistance of the silicone fused surface 24 eliminates slippage of the bowling ball from the hand thus enabling the maximum velocity of revolution around the central axis of the ball to increase the number of ball revolutions that accompany the velocity of travel of the ball as it traverses the bowling lane surface. The revolution imparted to the velocity of travel of the ball by the invention, counterclockwise for the right handed bowler and clockwise for the left handed bowler, produces a curving of the line of travel of the ball as the ball approaches the pins which is desirable and enables the ball to make contact with the pins at the proper angle. This proper angle of contact in addition to increased revolutions imparted to the ball as the tangentially directed shear resistance force is suddenly applied about the central axis of the ball upon ball grip release serve to force the pins into increased disarray when struck by the ball. The improved grip of the ball imparted by the invention lessening the effort of delivery of the ball to the lane surface enables the bowler to employ a ball lighter in weight and thereby, allowing the bowler to deliver the ball to the lane surface with a greater velocity of travel. Thusly, the kinetic energy imparted to the pins is greater because the velocity is the most significant component of the equation (kinetic energy=½ mass of bowling ball multiplied by velocity of travel squared).

The thickness of the silicone coatings of the fusion serve to stiffen the finger sleeves 7, 8, 10, 11, by increased coating and thickness thereby enabling a splinting characteristic of finger sleeves 7, 8, 10, 11, which allows greater control of ball direction and more efficient application of the tangential force of shear resistance, and also, the thickness of the silicone coatings of the fusion serve to cushion impact to the joints of the fingers, hand, and wrist thus protecting the joints and decreasing inflammation that causes tendonitis. The softer silicone 26 of the fusion which is inside the glove on the internal aspect of the front surface FIG. 3, FIG. 4, FIG. 5, FIG. 6 has the medical property of softening callouses, and scars when placed in contact with the skin thus further increasing the comfort and well-being of the bowling hand.

What is claimed:

1. A sports aid glove comprising:

a highly flexible elastomeric glove body having a palm side and an oppositely disposed back side and having open-ended finger sleeves for the long and ring fingers, and having finger sleeves for the index and little fingers, and an open-ended sleeve for the thumb disposed from the side of the glove body; and a prosthetic quality silicone surface coating on the external aspect of the palmar side of the index, long, ring and little finger sleeves.

2. The glove of claim 1, wherein the silicone surface is thermally fused to the elastomeric material of the glove.

3. The sports aid glove of claim 1, and further comprising a silicone surface coated on the finger sleeves on the internal aspect of the palmar side of the index, long, ring and little finger sleeves.

4. The sports aid glove of claim 1, and further comprising a silicone surface coating on the finger sleeves of both index and little fingers on the external aspect of the palmar side, having been applied with additional thickness to produce firmer, stiffer finger sleeves which have the ability to function additionally as splints.

5. The sports aid glove of claim 1, and further comprising a silicone surface disposed on at least one of the external aspect and the internal aspect of the palmar portion of the glove body.

6. The sports aid glove of claim 5, and further comprising a discontinuity in the silicone surface between all finger sleeves and the palmar portion of the glove body on the internal aspect of the glove body.

7. The sports aid glove of claim 1, and further comprising a silicone surface disposed as part of the palmar portion of the glove body extending in continuity with the attachment of the thumb sleeve on at least one of the external aspect and the internal aspect of the palmar surface of the thumb sleeve.

8. The sports aid glove of claim 1, and further comprising a discontinuity in the silicone surface between all finger sleeves and the palmar portion of the glove body on the external aspect of the glove body.

9. The sports aid glove of claim 1, wherein the silicone surface coated to the external aspects of the glove body is of a prosthetic quality having a firm Shore durometer hardness.

10. The sports aid glove of claim 1, wherein the glove body has a proximally disposed wrist segment which allows entrance of the hand and fingers into the glove, and includes securing means to thereby secure the glove to the wrist of a user of the glove.

11. The sports aid glove of claim 1, wherein the silicone surface is coated on the glove by thermal fusion.

12. The sports aid glove of claim 1, wherein at least one of the sleeves of all the finger sleeves and the thumb sleeves is of variable length.

13. A sports aid glove comprising:

a highly flexible elastomeric glove body having a palm side and an oppositely disposed back side and having open-ended finger sleeves for the long and ring fingers and having sleeves for the index and little fingers, and an open-ended sleeve for the thumb disposed from the side of the glove; and a prosthetic quality silicone surface coated on the internal aspect of the palmar side of the index, long, ring and little finger sleeves.

14. The sports aid glove of claim 13, and further comprising a silicone surface disposed as part of the finger sleeves of both index and little fingers on the external aspect of the palmar side, having been applied with additional thickness to produce firmer, stiffer finger sleeves which have the ability to function additionally as splints.

15. The sports aid glove of claim 13, and further comprising a silicone surface disposed as part of the palmar portion of the glove body extending in continuity with the attachment of the thumb sleeve on at least one of the external aspect and the internal aspect of the thumb sleeve.

16. The sports aid glove of claim 13, wherein the thumb sleeve and the finger sleeves of the long and middle fingers are of variable length.

17. The sports aid glove of claim 13, wherein the silicone surface coated on the internal aspects of the glove body is of a prosthetic quality having a soft Shore durometer, and is nonirritating to the skin of a user.

18. A sports aid glove comprising:

a highly flexible elastomeric glove body having a palm side and an oppositely disposed back side and having finger sleeves for the thumb and the long, ring index and little fingers, and a prosthetic quality silicone surface coating fused onto at least one of the internal aspect and the external aspect of the palm side of the glove and onto at least a portion of at least one of the internal aspect and the external aspect of the palmar side of the index, long, ring and little finger sleeves.

19. A method of making a sports aid glove having a palm side and an oppositely disposed back side and having open-ended finger sleeves for the long and ring fingers, and closed-ended finger sleeves for the index and little fingers, and an open-ended sleeve for the thumb disposed from the side of the glove body, comprising the steps of:

mixing together a thick paste activator and base components of a silicone;

combining the mixture of paste activator and base components with a solvent to cause the silicone to become pourable;

exposing the pourable silicone to a vacuum to remove all air and gaseous solvent;

coating preselected areas of elastomeric material of the glove with a layer of the silicone; and then heat curing the silicone layer on the glove until the silicone on the glove becomes formed, solid, stable and fused to the elastomeric glove material.

20. The method of claim 19, wherein the step of coating the silicone includes coating the silicone on preselected portions of at least one of the internal and external aspects of the palmar side of the glove.

21. The method of claim 20, wherein the step of coating the silicone includes coating the silicone on preselected portions of the palmar side of both the internal and external aspects of the glove.

* * * * *